US005165692A

United States Patent [19]

D'Agostino

[11] Patent Number: 5,165,692

[45] Date of Patent: Nov. 24, 1992

[54] GAME BOARD WITH MOVABLE PIECES

[76] Inventor: Angelo A. D'Agostino, 11 Ekes Ct., Sussex, N.J. 07461

[21] Appl. No.: 832,818

[22] Filed: Feb. 7, 1992

[51] Int. Cl.[5] ..... A63F 3/00

[52] U.S. Cl. ..... 273/242; 273/281

[58] Field of Search ..... 273/281, 284, 287, 264, 273/271, 255, 153 S, 242

[56] References Cited

U.S. PATENT DOCUMENTS

| | | | |
|---|---|---|---|
| 196,532 | 10/1877 | Martin | 273/153 S |
| 1,433,919 | 10/1922 | Taketoshi | 273/291 |
| 1,741,832 | 12/1929 | Farrell | 273/246 |
| 3,689,072 | 9/1972 | Taylor | 273/281 |
| 3,706,457 | 12/1972 | Gonzales et al. | 273/281 |
| 3,814,433 | 6/1974 | Mellor | 273/153 S |
| 4,018,446 | 4/1977 | Keegon | 273/281 |
| 4,042,245 | 8/1977 | Zarour | 273/246 |
| 4,486,021 | 12/1984 | Karas | 273/255 |
| 4,629,194 | 12/1986 | Spero et al. | 273/236 |
| 4,708,348 | 11/1987 | Zaruba et al. | 273/246 |

*Primary Examiner*—Benjamin H. Layno

[57] ABSTRACT

A game board includes six longitudinal tracks and thirty-six discs of two different colors arranged six in each track. There are eighteen discs of each color, so that three of each color are in each track with the colors alternating. The two colors alternate between adjacent tracks as well as within each track, with the first and last disc in each adjacent track having different colors. Two players face each other at opposite ends of the board and choose a color. Moves are made by the roll of a die which determines the number of discs each person must move across a center line. Each player moves the selected color disc, with the other color disc in its path included in the number. Moves can be split between different tracks and can go back and forth across the center line. The number on the die must be completed in two moves. The object of the game is to establish six of the selected color discs at the ends of the six rows closest to the center line. The first to obtain that arrangement is the winner. A great deal of thought and skill is required to achieve the desired result.

5 Claims, 1 Drawing Sheet

GAME BOARD WITH MOVABLE PIECES

BACKGROUND OF THE INVENTION

1. Field of the Invention

The present invention relates to a game board and particularly to a game board utilizing movable pieces of two alternating indicia or colors which are moved along longitudinal tracks back and forth across a center line. A die, or other means of chance, determines the number of pieces to be moved by a person selecting one of the colored pieces. The final location of the pieces of one color in a plurality of tracks determines the winner.

2. Description of the Prior Art

The use of game boards having movable pieces of two different colors which are moved in linear paths has been known. Many of these are games of chance which require little or no skill. Others are relatively complex with rules which are difficult to follow. Examples are shown in U.S. Pat. No. 4,042,245, which shows the use of color-coded squares on a board and a color-coded die, with game pieces moved incrementally along tracks corresponding to the number on the die. A plurality of lanes in the form of an oval represents a racetrack with movement of pieces dependent entirely on chance and luck.

U.S. Pat. No. 4,629,194 utilizes a square game board with eight lines along each edge forming sixty-four squares. Each player has a certain number of color-coded discs which also have other markings and numbers. After specified manipulations of the discs, the player having the highest score of the sum of the numbers on the upper faces of the remaining discs is the winner.

U.S. Pat. No. 4,708,348 includes game pieces which are held captive in openings in the game board to prevent loss or removal. The pieces are moved along slotted paths to particular stop positions determined by a spinner and the rules of the game. In one variation, the player pieces are advanced toward a goal, with the first player reaching the goal being the winner.

U.S. Pat. No. 1,741,832 describes a race course divided into four lanes and spaces along the lanes representing distance and time. The game pieces may be discs representing runners with movement determined by the toss of a die.

U.S. Pat. No. 1,433,919 relates to a game board having eight squares in each direction for a total of sixty-four. Flat disc playing pieces are manipulated to capture oppositely designated discs. Different letters or colors are used by two players and each disc has a numerical or other symbol. When all pieces are captured or no more moves are possible, the game ends. The person with the greatest number of pieces of the designated symbol or color or numerical total may be the winner.

While these game boards show individual elements of the present game, there is no indication of the alternate track and color arrangement with discs movable back and forth along the tracks in order to establish a particular winning combination.

SUMMARY OF THE INVENTION

It is, therefore, the primary object of the present invention to provide a new inexpensive game requiring skill and thought to achieve the winning arrangement;

It is another object to provide a simple game board and apparatus having a unique configuration of tracks and game pieces to be manipulated in a manner which will provide continued interest and exercise the skill of the players;

It is a further object of the game to move the pieces in a manner requiring imagination and creativity to establish the desired number of one type of disc in the locations in the plurality of tracks which is the winning arrangement.

These objects are achieved with a novel game board and apparatus having a predetermined number of longitudinal tracks or rows and game pieces of a given number which are equally divided among the tracks. Indicia on the game pieces provide an alternating pattern within each track and with respect to adjacent tracks. The pieces are preferably held within the tracks by means on the game board to facilitate movement in the desired track. Two players at opposite ends of the board select a desired indicia. Roll of a die or other means of chance determines the number of the game pieces to be moved by each player. Moves must be made across a center line, with the selected piece moving any other piece in its path to be included in the number of pieces to be moved. The pieces moved in each direction across the center line are counted, and the number can be split between different tracks. The number on the die must be completed in two moves. The first player to establish the location of the selected indicia game pieces at the end of a given number of rows closest to the center line is the winner. Other objects and advantages of this novel game will become apparent from the following description in conjunction with the accompanying drawings.

DESCRIPTION OF THE PREFERRED EMBODIMENT

Figure 1:
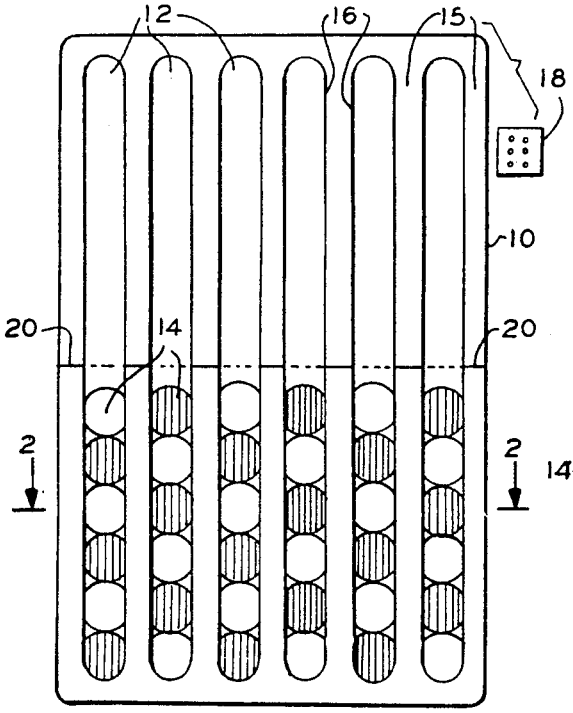
FIG. 1 is a top plan view of the game board and pieces arranged in a starting position.
Figure 2:
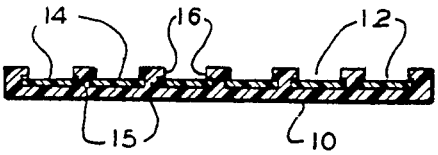
FIG. 2 is an end cross-sectional view of the game board showing the game pieces slidable and secured within the tracks.

As shown in FIGS. 1 and 2, a game board 10 includes six longitudinal like parallel tracks or rows 12 running the length of the board. A plurality of round flat discs 14, totalling thirty-six in number, are distributed equally with six in each track. The discs are divided into two groups, each having a different common indicia, such as two colors, shown symbolically as White and Red, which are disposed in an alternating pattern. Each row starts with one color and ends with another, having three of each which alternate between White and Red. Each adjacent row starts with the other color and likewise alternates so that the colors alternate within each row as well as with respect to the adjacent row. There are eighteen discs of each color. The discs are slidable and preferably captured within each track by vertical walls 15 having horizontal extensions or flanges 16 running along the length of each track to retain the discs and prevent falling out or loss. This also facilitates the movement of the discs along the tracks and permits movement of a plurality of discs together. A die 18, or other means of chance such as a spinner, is used to determine the number of discs to be moved by each player. The discs must be moved across a center line 20.

In order to play the game, the players choose one of the colors for their set of discs and sit at opposite sides of the board. A roll of the die determines which player starts first and the number of discs to be moved across the center line. The number includes both the disc of the selected color as well as other discs in its path which are those of the opposing player. Each move of a disc across the center line in either direction is counted including back and forth movements. The number of discs to be moved may be split between tracks and the number must be used and completed within no more than two moves.

Figure 3:
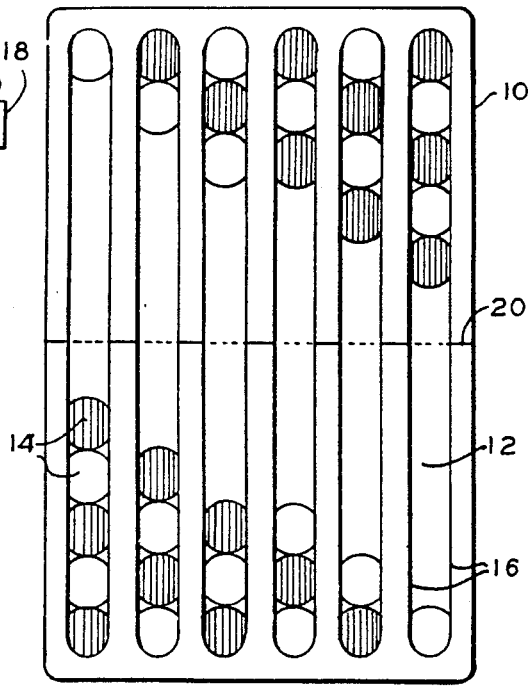
FIG. 3 is a plan view showing the game pieces at various positions during the course of the game.

For example, if the Red player rolls a number six on the die, he or she may choose to move the first upper Red disc in the first row on the left of FIG. 1 across center line 20 with the upper White disc being moved in its path, thus counting for two discs moved. The player may also move four discs including two Red and two White across the line in the third row to complete the number on the die. If the White player then rolls a three on the die, White may move the upper White disc in the second row along with the Red disc in its path across the center line and then return the White disc back across the line to the original position and thus complete that number. Once the player's hand is removed from the piece being moved, the move is over. Each player continues to take a turn rolling the die and completing the number of discs to be moved following the rules as set forth above. FIG. 3 represents an intermediate position of the discs during the course of the game.

Figure 4:
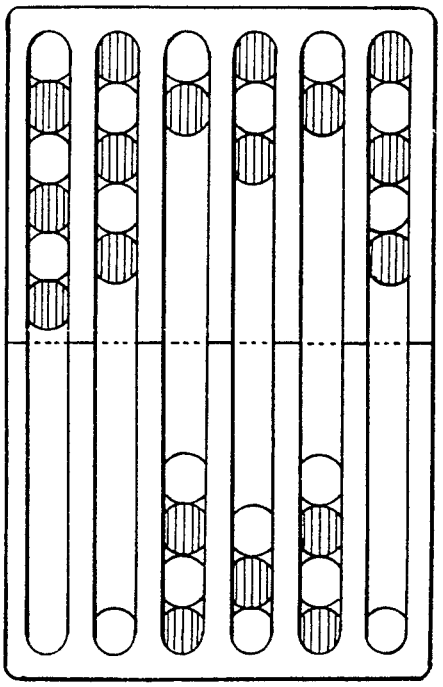
FIG. 4 is a plan view showing an example of a winning arrangement of game pieces.

After much back and forth offensive and defensive maneuvering which requires skill that is acquired with continued play, an example of a winning position is shown in FIG. 4. In this case, the player with the Red discs has that color at the end of six rows closest to the center line at the upper end of the board, while White discs are at the end of only five rows at the lower end of the board. The first player to accomplish this arrangement of six of the same colored discs at the inner end of six rows is the winner, while the loser will have five or less of the other color at the ends.

The present invention thus provides a unique stimulating game which requires skill and imagination to achieve the winning arrangement. While only a single embodiment has been illustrated and described, many variations may occur in the game board configuration such as the game pieces having different shapes, designs or symbols as the indicia for the two groups, and the tracks having holes or slots for engaging the pieces. Such variations of the particular configuration may be made without departing from the scope of the invention as set forth in the appended claims.

What is claimed is:

1. A game board comprising:

a playing surface having a plurality of like longitudinal rows and a center line between opposite ends;

a plurality of game pieces positioned along said rows; means for movably attaching said game pieces to said board wherein each game piece is restricted to only back and forth movement along the row it is positioned on, said pieces including two groups, the pieces of each group having an indicia different from each other group, each row receiving a like number of each group of game pieces the game pieces within each row being arranged so as to alternate between pieces of each group, the game pieces in each row alternating oppositely with respect to the game pieces in each adjacent row; and means of chance for determining the number of game pieces to be moved by each player in turn across said center line.

2. The game board of claim 1 wherein said game pieces are flat round discs, said means for movably attaching said game pieces comprising longitudinal rows having vertical walls extending therealong and separating said rows, said walls having horizontal flanges extending over and along said rows and retaining said discs within said rows, a plurality of said discs being slidable together within said rows.

3. The game board of claim 2 including six longitudinal rows, thirty-six discs including eighteen of each group, six discs being positioned within each row including three of each group alternating with each disc of the other group.

4. The game board of claim 3 wherein said means of chance is a six-sided die having indicia thereon representing numbers from one to six.

5. The game board of claim 4 wherein said different indicia for each group of discs are different colors.

* * * * *